US007271679B2

(12) United States Patent
Lundberg et al.

(10) Patent No.: US 7,271,679 B2
(45) Date of Patent: Sep. 18, 2007

(54) APPARATUS AND METHOD TO FACILITATE WIRELESS COMMUNICATIONS OF AUTOMATIC DATA COLLECTION DEVICES IN POTENTIALLY HAZARDOUS ENVIRONMENTS

(75) Inventors: James Lundberg, Snohomish, WA (US); Robert A. Zigler, Marysville, WA (US); For Sander Lam, Bothell, WA (US)

(73) Assignee: Intermec IP Corp., Everett, WA (US)

( * ) Notice: Subject to any disclaimer, the term of this patent is extended or adjusted under 35 U.S.C. 154(b) by 260 days.

(21) Appl. No.: 11/172,375

(22) Filed: Jun. 30, 2005

(65) Prior Publication Data

US 2007/0001778 A1 Jan. 4, 2007

(51) Int. Cl.
*H01P 5/00* (2006.01)
*H01Q 1/42* (2006.01)

(52) U.S. Cl. ..... 333/24 C; 343/700 MS; 343/872

(58) Field of Classification Search ..... 333/24 C; 343/700 MS, 825, 826, 845, 872; 455/73
See application file for complete search history.

(56) References Cited

U.S. PATENT DOCUMENTS

| | | | | |
|---|---|---|---|---|
| 4,477,785 | A | 10/1984 | Atia | |
| 4,812,778 | A | 3/1989 | Gryk | |
| 6,263,193 | B1 * | 7/2001 | Iseki et al. | 455/84 |
| 6,919,782 | B2 | 7/2005 | Sauder et al. | |
| 7,095,372 | B2 * | 8/2006 | Castany et al. | 343/700 MS |

FOREIGN PATENT DOCUMENTS

| | | |
|---|---|---|
| EP | 0197653 A2 | 10/1986 |
| EP | 1403832 A1 | 3/2004 |
| JP | 10-13130 | 1/1998 |

* cited by examiner

*Primary Examiner*—Dean Takaoka
(74) *Attorney, Agent, or Firm*—Seed IP Law Group PLLC

(57) ABSTRACT

A system useful in providing communications with automatic data collection (ADC) devices employs an antenna located in a potentially hazardous environment, a radio circuit located in a non-hazardous environment, and a coupling apparatus to provide an interface between the antenna and the radio circuit that prevents electrical discharges from occurring in the potentially hazardous environment.

29 Claims, 6 Drawing Sheets

APPARATUS AND METHOD TO FACILITATE WIRELESS COMMUNICATIONS OF AUTOMATIC DATA COLLECTION DEVICES IN POTENTIALLY HAZARDOUS ENVIRONMENTS

BACKGROUND OF THE INVENTION

1. Field of the Invention

This disclosure generally relates to the field of automatic data collection (ADC), for example, data acquisition via machine-readable symbols and readers, radio frequency identification (RFID) tags and readers, magnetic stripes and readers, and more particularly relates to providing communications in potentially hazardous environments, for example, between one or more ADC readers and one or more host computing systems.

2. Description of the Related Art

The ADC field includes a variety of different types of ADC data carriers and ADC readers operable to read data encoded in such data carriers. For example, data may be encoded in machine-readable symbols, such as barcode symbols, area or matrix code symbols and/or stack code symbols. Machine-readable symbols readers may employ a scanner and/or imager to capture the data encoded in the optical pattern of machine-readable symbol. RFID tags may store data in a wirelessly accessible memory, and may include a discrete power source, or may rely on power derived from an interrogation signal. RFID readers typically emit a radio frequency (RF) interrogation signal that causes the RFID tag to respond with a return RF signal encoding the data stored in the memory. Magnetic stripes encode data in patterns of magnetic particles. Such magnetic stripes are commonly, for example appearing on the back of credit, debit or gift cards. Magnetic stripe readers typically employ a magnetic reading head, with a slot through which the magnetic stripe is drawn. Other types of data carriers and readers exist, for example optical memory tags and touch memories.

Most ADC systems employ a number of ADC readers which may be distributed about one or more locations to collect data from the data carriers, and may employ one or more host computing systems that act as central depositories to store and/or process and/or share data collected by the ADC readers. In many applications, it is beneficial to provide wireless communications between the ADC readers and the host computing system. Wireless communications allow the ADC readers to be mobile, may lower the cost associated with installation of an ADC system, and permit flexibility in reorganizing a facility, for example a warehouse. ADC systems may employ wireless access points distributed throughout a facility to facilitate such wireless communications.

Some applications require the operation of ADC readers and other equipment in a potentially hazardous environment. For example, ADC readers may be placed in a combustible environment such as one with a high concentration of oxygen or other combustible gas, or one in which an unintentional leak of a combustible gas may occur. Test and certification laboratories provide intrinsically safe ratings warranting that equipment which such a rating cannot create a, spark that may ignite a potentially combustible environment. The testing and certification laboratories carefully review the equipment prior to providing such a rating, to ensure that such hazardous conditions cannot occur in either normal operation or in the presence of faults. Several devices are already available that isolate low voltage circuits and provide the intrinsically safe rating through supplemental protection circuits. There appears to be no such supplemental circuit currently available for RF devices. It would be highly desirable in the communications industry to be able to provide wireless communications in a potentially hazardous environment.

BRIEF SUMMARY OF THE INVENTION

A protection network for RF signals may facilitate wireless communications in potentially hazardous environments, for example, allowing an antenna to be located in a potentially hazardous environment to maintain wireless communications with other intrinsically safe rated equipment, and also allowing non-intrinsically safe rated radio equipment to be located in a non-hazardous environment which does not demand the same high performance features and/or rating.

For example, mobile digital clients may need to be connected with a radio to a computing system. While several mobile devices now available have sufficient safety ratings, there does not appear to be any supplemental protection circuits available for the radio that connects to a company infrastructure. It would be desirable to be able to install normal access points throughout the company's facilities. The access point could be installed in areas that did not have potentially combustible environments, antennas could be installed in areas that have or may have potentially combustible environments, and the access point and antennas may be coupled via an intrinsically safe rated RF coupler by appropriate hard wired connections such as RF cables. The intrinsically safe rated RF coupler serves as a barrier, preventing potentially hazardous electrical signals or discharges from reaching the environment that has or may have potentially combustible gas.

Also for example, readers with radios, such as RFID readers, may need a connection to interface with RFID tags. The RFID tags are typically limited in power, and will comply with most intrinsically safe rating requirements. However, the radio circuit of the typical RFID reader is sufficiently powerful that it is difficult to comply with the intrinsically safe rating requirements. Thus, it is difficult or impossible to locate the RFID reader in a potentially hazardous environment. One solution, is to locate an antenna circuit in the potentially hazardous environment, along with the RFID tags, and while locating the RF circuit of the RFID reader in non-hazardous or non-combustible environment with an intrinsically safe rated RF coupler providing isolation between the antenna and the RF circuit.

In one embodiment, a coupling apparatus to provide signal coupling between an antenna and a radio comprises: a conductive enclosure comprising a first resonance cavity and a second resonance cavity; a first coupling antenna received in the first resonance cavity, and electrically direct current shorted to the conductive enclosure; a second coupling antenna received in the second coupling antenna cavity and spaced from the first coupling antenna; a first connector mounted through a portion of the conductive enclosure to provide a first signal conduit between an exterior of the conductive enclosure and the first coupling antenna; and a second connector mounted through a portion of the conductive enclosure to provide a second signal conduit between the exterior of the conductive enclosure and the second coupling antenna.

In another embodiment, an apparatus to couple signals between communications components comprises: a first conductive resonance cavity; a second conductive resonance cavity; an electrically direct current shorted first coupling antenna received in the first conductive resonance cavity; a second coupling antenna received in the second conductive resonance cavity, and spaced from the first coupling antenna, wherein the first and second conductive resonance cavities are sealed from an exterior ambient environment, and the second conductive resonance cavity is separated from the first conductive resonance cavity by a conductive partition, the conductive partition having an aperture therethrough to provide a wireless communications path between the first coupling antenna in the first conductive resonance cavity and the second coupling antenna in the second conductive resonance cavity; a first connector accessible from the exterior ambient environment and providing a first environmentally sealed signal path to the first coupling antenna in the first resonance cavity; and a second connector accessible from the exterior ambient environment and providing a second environmentally sealed signal path to the second coupling antenna in the second resonance cavity.

In still another embodiment, a method of forming an apparatus comprises: forming a first coupling antenna on a dielectric substrate; forming a second coupling antenna on the dielectric substrate, the second coupling antenna spaced from the first coupling antenna; positioning the dielectric substrate in an enclosure having a first resonance cavity and a second resonance cavity such that the first coupling antenna is located in the first resonance cavity and the second coupling antenna resides in the second resonance cavity; providing a direct current shorting path between the first coupling antenna and the enclosure; providing an environmentally sealed signal path between an exterior of the enclosure and the first coupling antenna; and providing an environmentally sealed signal path between an exterior of the enclosure and the second coupling antenna.

In a further embodiment, a method of using an apparatus comprises: locating an antenna in a hazardous environment; locating a radio circuit in a non-hazardous environment; and coupling the radio and the antenna with a coupling device comprising an enclosure sealed to an ambient environment, the enclosure having a first conductive resonance cavity and a second conductive resonance cavity, a first coupling antenna positioned in the first conductive resonance cavity and a second coupling antenna positioned in the second conductive resonance cavity, the first coupling antenna having a direct current short to the enclosure, and at least one aperture coupling the first and second conductive resonance cavities.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE INVENTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with ADC data carriers and readers, computer and/or telecommunications networks, and/or computing systems have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Further more, the particular features, structures, or characteristics may be combined in any suitable manner in one or more embodiments.

The headings provided herein are for convenience only and do not interpret the scope or meaning of the embodiments.

Figure 1:
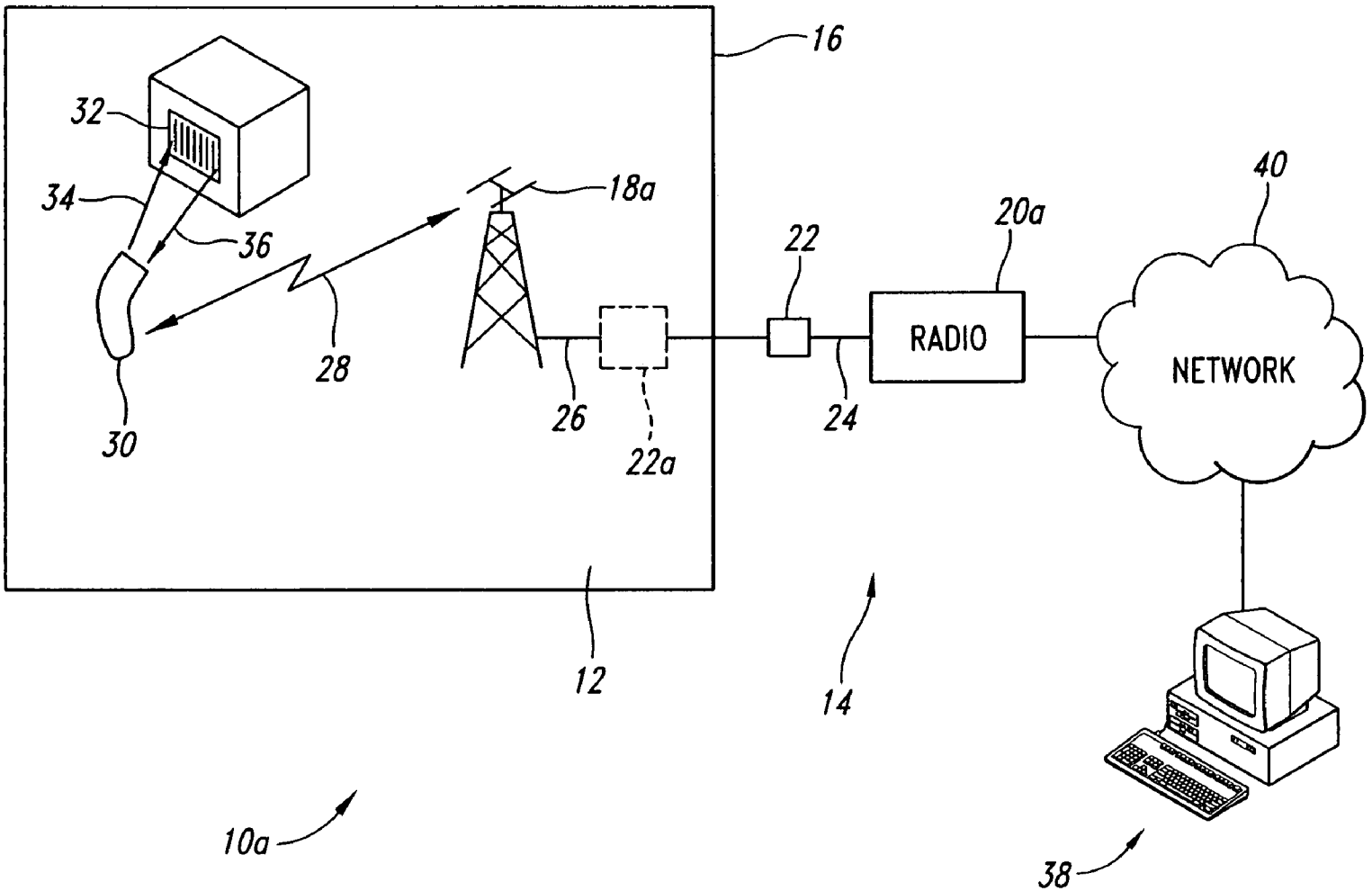
FIG. 1 is a schematic diagram showing an antenna located in a potentially hazardous environment coupled to a radio located in a non-hazardous environment via a coupling apparatus, for providing communications between wireless communications devices, for example ADC readers, located in the potentially hazardous environment and one or more networked computing systems located outside the potentially hazardous environment, according to one illustrated embodiment.

FIG. 1 shows a data collection system 10*a* having components distributed between a potentially hazardous environment 12 and a non-hazardous environment 14. The potentially hazardous environment 12 is separated from the non-hazardous environment 14 by a barrier or partition 16. The potentially hazardous environment 12 may be one in which a risk of combustion is elevated with respect to the non-hazardous environment 14, due, for example, to an elevated concentration of combustible gases. For example, the potentially hazardous environment 12 may be an environment with a particularly high level of oxygen and/or hydrogen. Thus, there is an incentive to reduce the potential of a spark occurring in the potentially hazardous environment 14.

The data collection system 10*a* may comprise an antenna 18*a* located in the potentially hazardous environment 12, a radio 20*a* located in the non-hazardous environment 14 outside the potentially hazardous environment 12, and a coupling apparatus or device 22 coupling the antenna 18 and radio 20. In some embodiments, the coupling apparatus 22 may be located in the non-hazardous environment 14. In other embodiments, the coupling apparatus (illustrated as broken line box 22*a*) may be sealed and hence located in the potentially hazardous environment 12. The radio 20 may be coupled to the coupling apparatus 22 via a first wired connection 24, for example a first coaxial cable, and the antenna 18 may be coupled to the coupling apparatus 22 via a second wired connection 26, for example a second coaxial cable.

The antenna 18 allows wireless communications 28 with one or more ADC devices, for example, a machine-readable symbol reader 30. The machine-readable symbol reader 30 is operable to read data encoded in a machine-readable symbol 32, for example, a barcode symbol, area or matrix code symbol, and/or stacked code symbol. The machine-readable symbol reader 30 typically employs either scanning or imaging to illuminate 34 the symbol 32 and receive light 36 returned from the illuminated symbol. The details of the construction and operation of machine-readable symbol readers are well known in the art and need not be discussed here further.

The radio 20 may be coupled to one or more computing systems 38 to store and/or process and/or share the collected data. The computing system 38 may take the form of one or more computers executing a server application. The computing system 38 may represent some or all of the computing infrastructure of a large organization. The radio 20 may be coupled to the computing system 38 via one or more networks 40, which may include local area networks (LANs), wide area networks (WANs), wireless LANs, or wireless WANs, including, but not limited to, intranets, extranets, and the Internet, including the World Wide Web.

Figure 2:
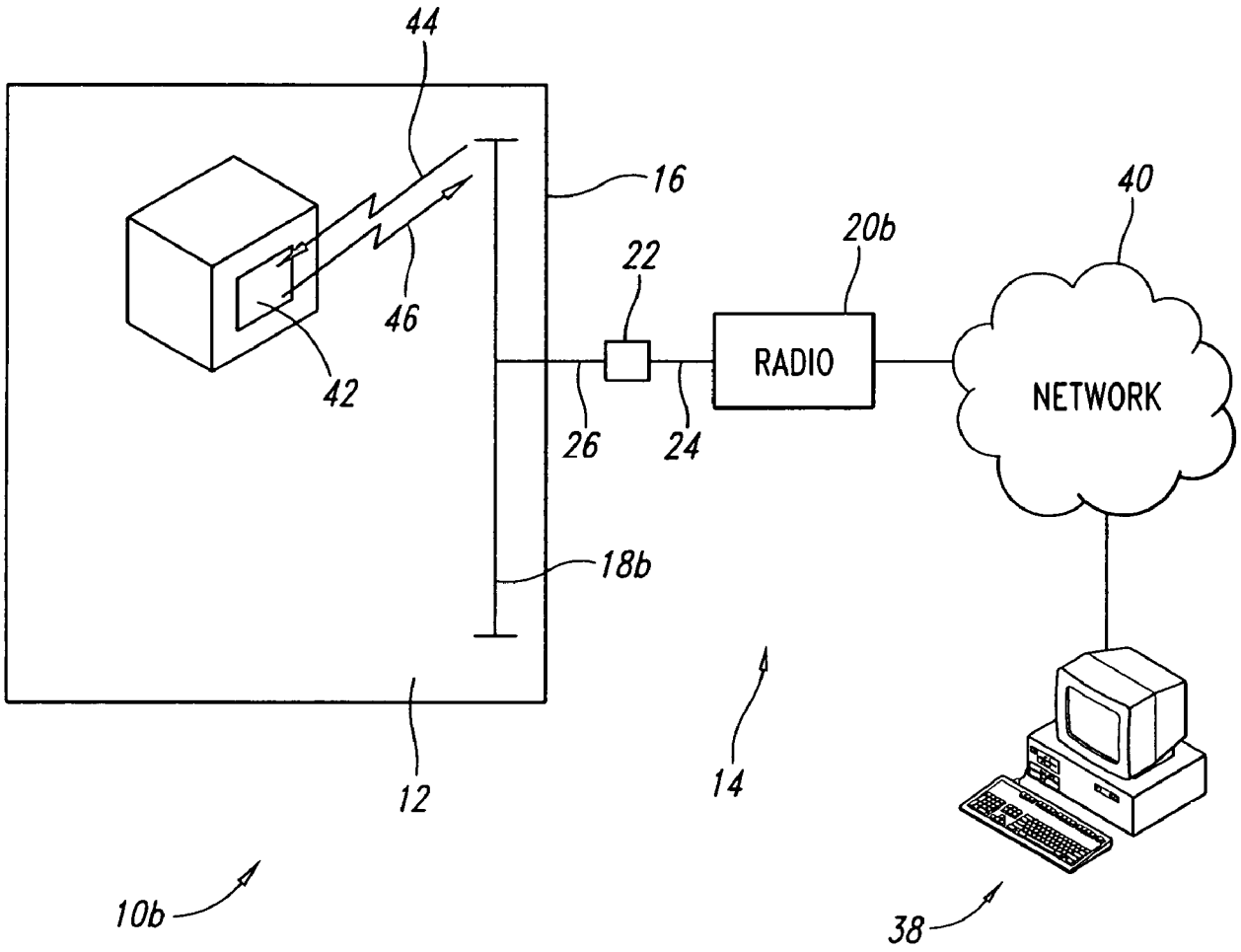
FIG. 2 is a schematic diagram showing an antenna located in a potentially hazardous environment and a device comprising a radio, for example an RFID interrogator, located outside the potentially hazardous environment and coupled to the antenna by a coupling apparatus to wirelessly interrogate data carriers such as RFID tags located in the potentially hazardous environment according to another illustrated embodiment.

FIG. 2 shows the data collection system 10*b* according to another illustrated embodiment.

In the embodiment of FIG. 2, the radio 20*b* takes the form of a portion of an RFID interrogator. The RFID interrogator interrogates RFID tags 42 by transmitting an RF interrogation signal 44 and receiving RF responses 46 emitted by the RFID tags 42. RFID tags 42 may be active (i.e., including discrete power source) or passive (i.e., relying on interrogation beam for deriving power). RFID tags 42 typically act as transponders, transmitting a response 46 to an interrogation signal 44 which encodes information or data stored in a memory of the RFID tag 42. Some RFID tags 42 may also be written to, and may employ security measures and/or encryption techniques. The structure and method of operation of RFID tags 42, as well as RFID interrogators are well known in the art and need not be discussed here further.

Figure 3:
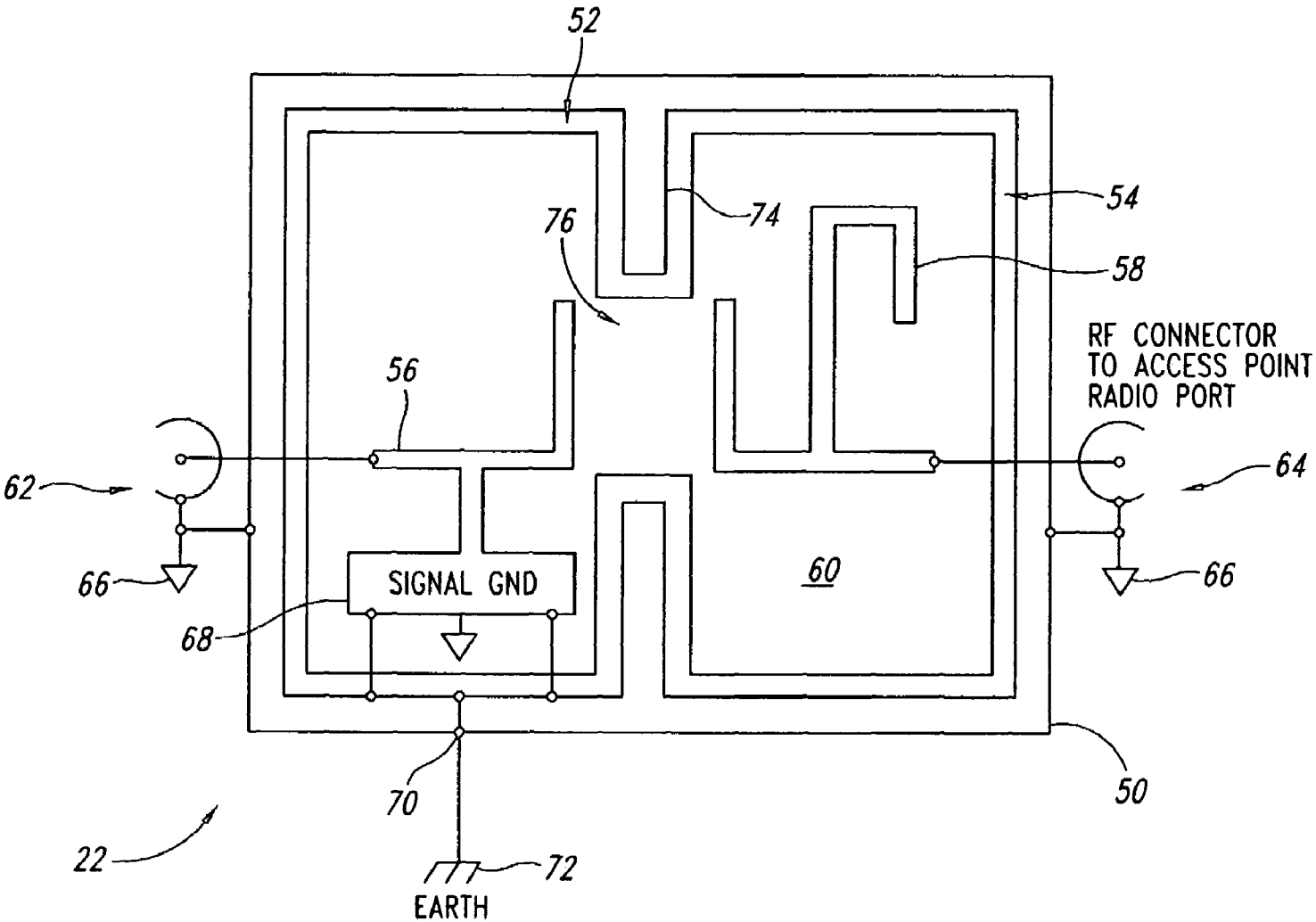
FIG. 3 is an electrical schematic diagram of the coupling apparatus of FIGS. 1 and 2, according to one illustrated embodiment.
Figure 4:
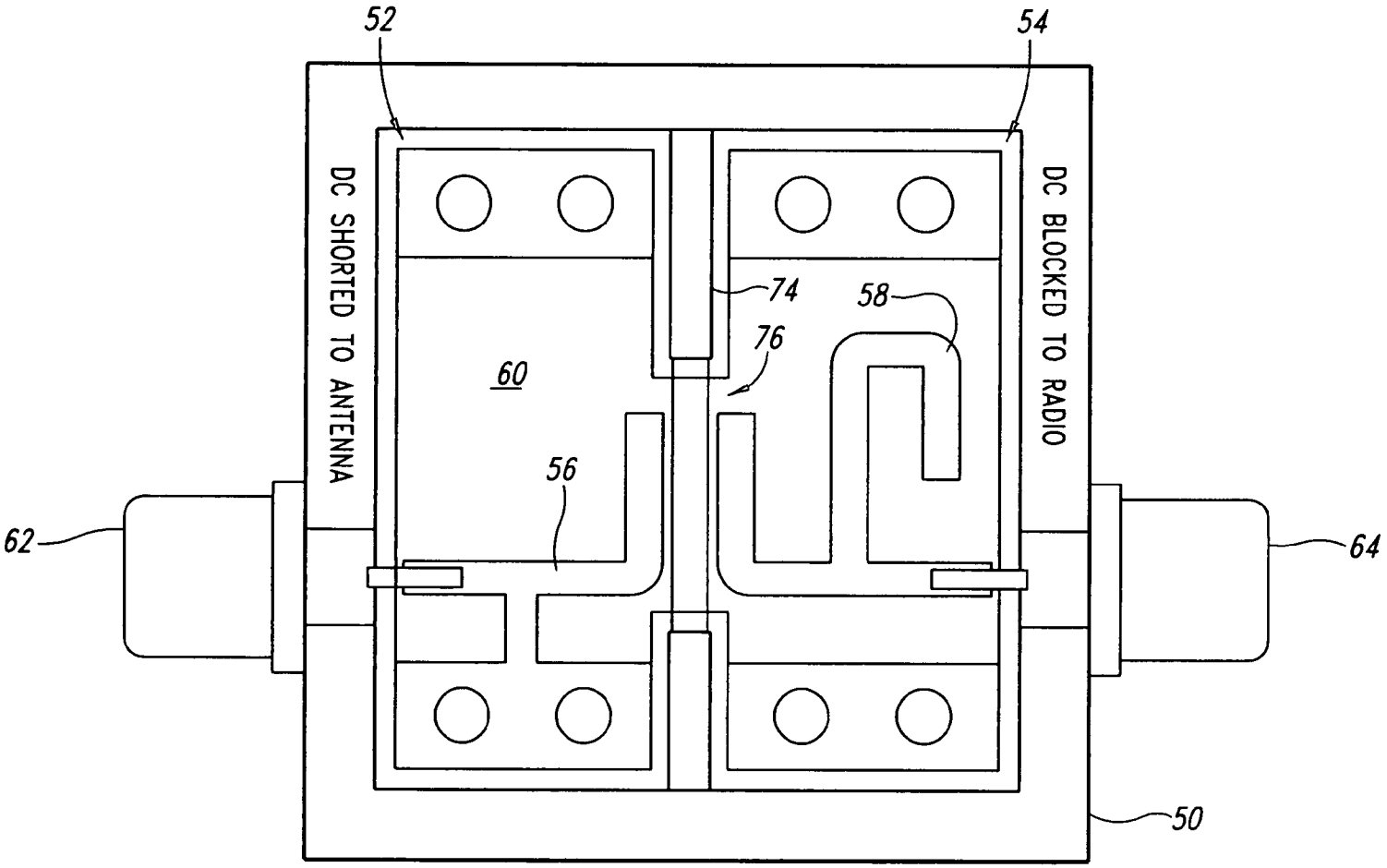
FIG. 4 is a cross-sectional view of the coupling apparatus according to one illustrated embodiment.

FIGS. 3 and 4 illustrate the coupling apparatus 22 according to one illustrated embodiment.

The coupling apparatus 22 comprises an enclosure 50 that seals an interior of the coupling apparatus 22 from an external ambient environment such as the potentially hazardous environment 12 or the non-hazardous environment 14. The enclosure 50 may be formed from a conductive material, for example, a conductive metal. The enclosure 50 forms a first conductive resonance cavity 52 and a second conductive resonance cavity 54 into which are received a first antenna 56 and second antenna 58, respectively.

The first and second antennas 56, 58 may be formed on a substrate 60. The substrate 60 includes at least one low-loss dielectric layer. As discussed in detail below, the first and second antennas 56, 58 may be formed by depositing a conductive material on the substrate 60, for example, by printing. Alternatively, or additionally, the first and second antennas 56, 58 may be formed by etching a conductive layer of the substrate 60 that is carried by the low-loss dielectric layer of the substrate 60. The antennas 56, 58 may be advantageously matched to an impedance of approximately 50 Ohm.

The coupling apparatus 22 further comprises a first connector 62 and second connector 64, each of which are accessible from an exterior of the enclosure 50, and which provide an environmentally sealed signal path into the enclosure 50. The first connector 62 is electrically coupled to the first antenna 56 to serve as an antenna port, while the second connector 64 is electrically coupled to the second antenna 58 to serve as a radio port. The connectors 62, 64 may, for example, take the form of N-type coaxial cable connectors. The coupling to the first and second antennas 56, 58 may be made via pins, wires, conductive traces or other coupling structures carried by the substrate 60. Each of the connectors 62, 64 is also electrically coupled to the enclosure 50 and a ground 66. The first antenna 56 includes a direct current (DC) short circuit path 68 to ground via the enclosure 50. The coupling apparatus 22 may further include a connector 70 to provide a connection to an earth ground 72.

The first antenna 56 may take the form of a quarter wave radiating element, i.e., having a dimension approximately equal to a quarter of a wavelength of the particular frequency at which the first antenna 56 will communicate with the second antenna 58. The second antenna 58 may take the form of a half wave radiating element, i.e., having a dimension approximately equal to one-half wavelength of the particular frequency at which the first antenna 56 will communicate with the second antenna 58.

The enclosure 50 may include a partition 74 between the first conductive resonance cavity 52 and the second conductive resonance cavity 54. The partition 74 may include an aperture 76 that forms an RF coupling gap between the conductive resonance cavities 52, 54. The size and shape of the aperture 76 may be selected to produce a determined amount of electromagnetic RF coupling, filter shape, bandwidth, and insertion loss.

Thus, the coupling apparatus 22 may be employed as a narrow band-pass filter with a DC electrical short circuit on the antenna port and a DC electrical open circuit on the radio port. The DC-shorted antenna prevents dangerous static voltage buildup. The DC-open port prevents any DC or AC power injection. Since the coupling apparatus 22 is narrow band, any signal other than the designed pass band signal is significantly attenuated. The narrow band limiting function also improves out-of-band strong interference rejection and EMI emission. The air gap isolation between the radio and antenna circuits means that even if there is a breakdown due to lightning or electromagnetic pulse induced surges, any spark that occurs will occur between radiation elements from the radio port to the metal partition 74 inside the sealed metal enclosure 50.

Figure 5:
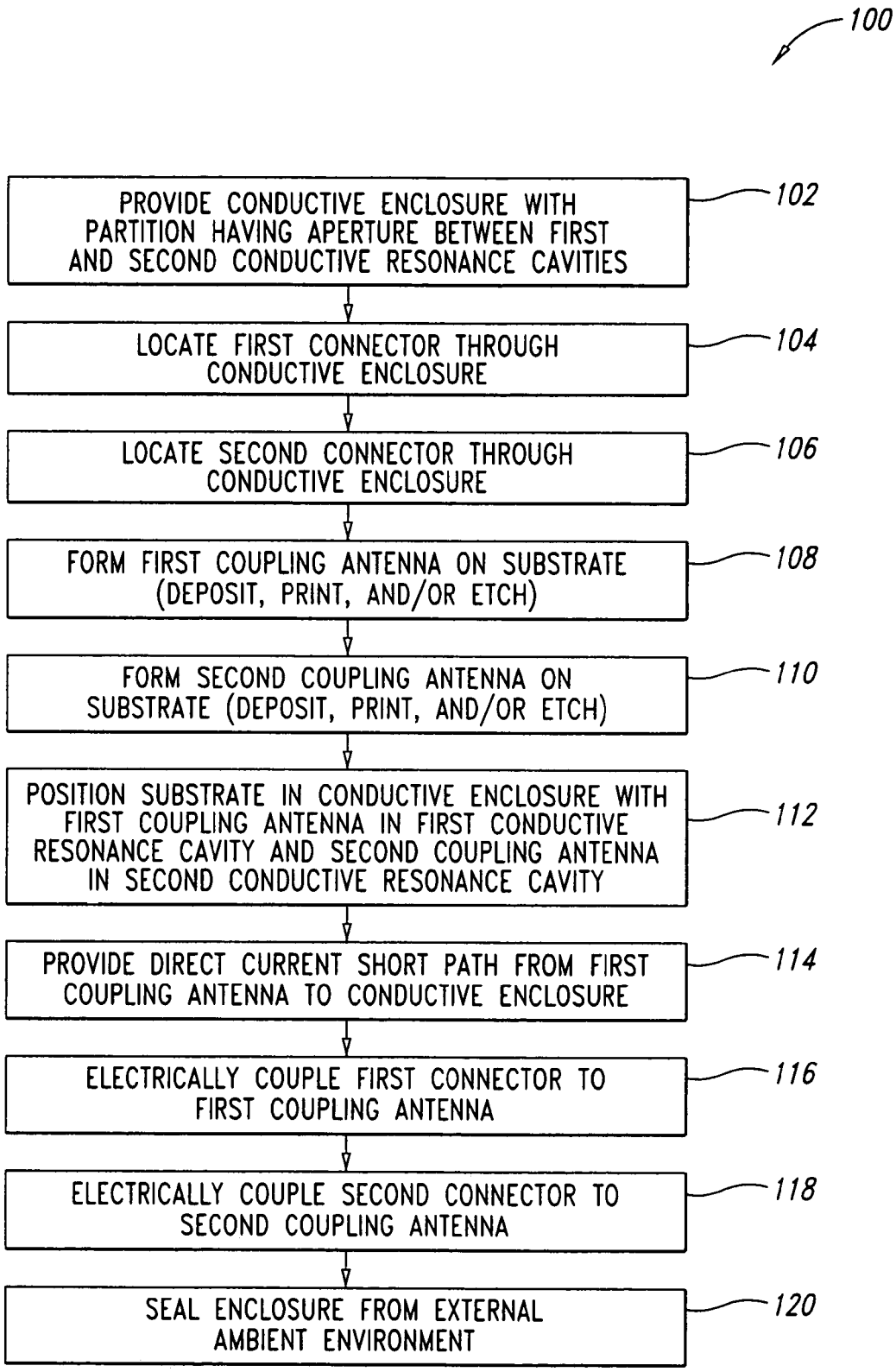
FIG. 5 is a flow diagram illustrating a method of manufacturing a coupling apparatus according to one illustrated embodiment.

FIG. 5 shows a method 100 of producing the coupling apparatus 22 according to one illustrated embodiment.

At 102, a conductive enclosure 50 is provided having a partition 74 with an aperture 76 between a first and second conductive resonance cavities 52, 54. At 104, the first connector 62 is located through the enclosure 50, providing a first sealed signal path from an exterior of the enclosure 50 into the first resonance cavity 52 in an interior of the enclosure 50. At 106, the second connector 64 is located through the enclosure 50, providing a second sealed signal path from an exterior of the enclosure 50 into the second resonance cavity 54 in an interior of the enclosure 50.

At 108, the first coupling antenna 56 is formed on the substrate 60. At 110, the second coupling antenna 58 is formed on the substrate 60. The first and/or second coupling antennas 56, 58 may be formed by depositing a conductive material onto a dielectric or insulative layer of the substrate 60, for example, by printing with a conductive ink. Alternatively, or additionally, the first and/or second coupling antennas 56, 58 may be formed by etching a conductive layer carried by a dielectric or insulating layer of the substrate 60. While shown as separate steps 108, 110, the first and second coupling antennas may be formed at the same time, or in opposite order as that represented in FIG. 5.

At 112, the substrate 60 is positioned in the enclosure 50, with the first coupling antenna 56 positioned in the first conductive resonance cavity 52 and the second coupling antenna 58 positioned in the second conductive resonance cavity 54. At 114, a direct current short circuit path 68 is provided from the first coupling antenna 56 to the conductive enclosure 50. At 116, the first connector 62 is electrically coupled to the first coupling antenna 56. At 118, the second connector 64 is electrically coupled to the second coupling antenna 58. The first and second connectors 62, 64 may be coupled to the respective coupling antennas 56, 58 in the opposite order as represented in FIG. 5, and/or may occur before the DC short circuit path is provided. At 120, the enclosure 50 is sealed from the ambient environment.

Figure 6:
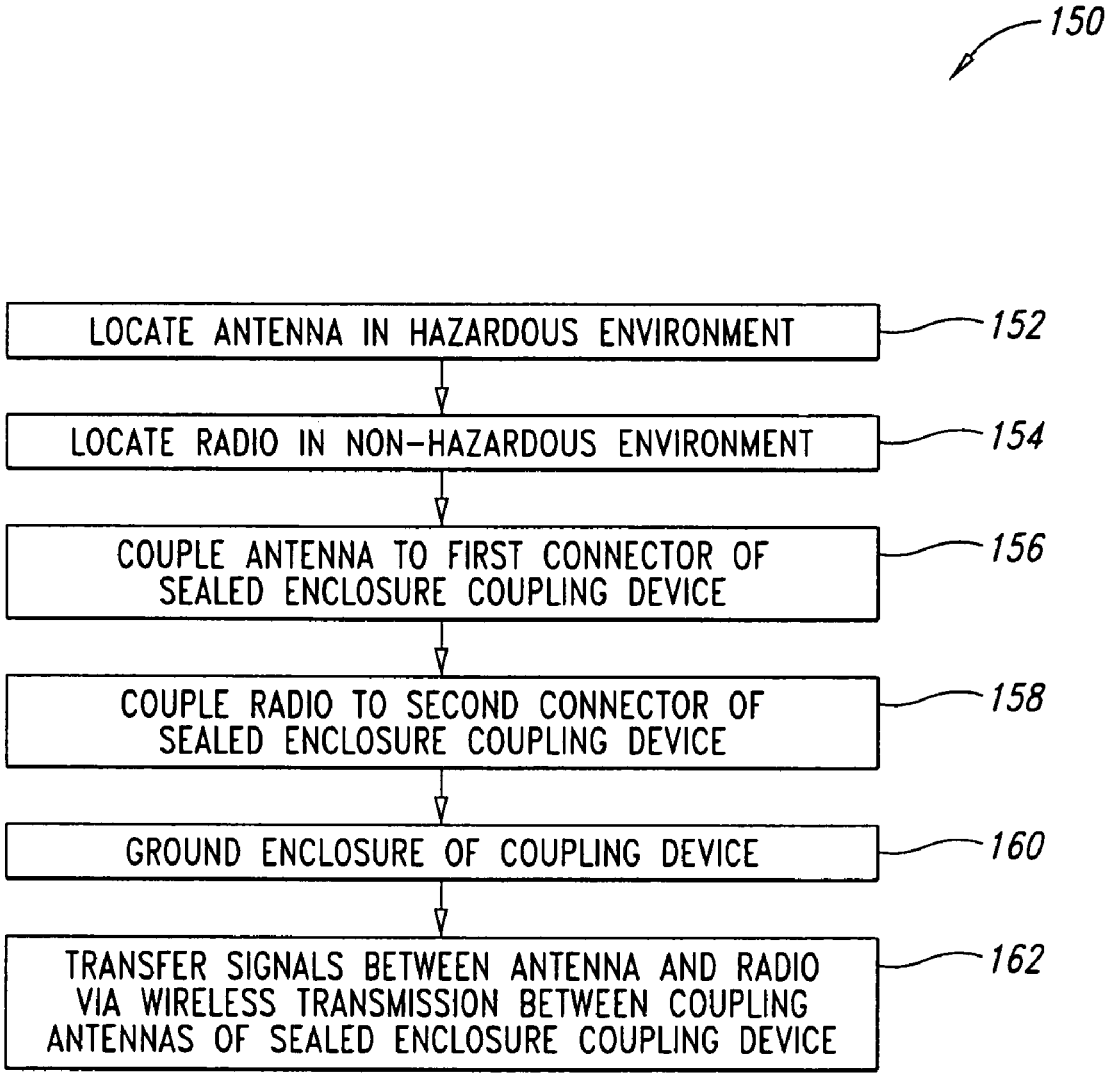
FIG. 6 is a flow diagram illustrating a method of using the antenna, radio, and coupling apparatus according to another illustrated embodiment.

FIG. 6 shows a method 150 of setting up and/or operating the data collection system 10*a*, 10*b* according to one illustrated embodiment.

At 152, the antenna 18*a*, 18*b* is located in the potentially hazardous environment 12. At 154, the radio 120*a*, 120*b* is located in the non-hazardous environment 14. At 156, the antenna 18*a*, 18*b* is electrically coupled to the antenna port or first connector 62 of the coupling apparatus 22, for example, via cable 26. At 158, the radio 20*a*, 20*b* is electrically coupled to the radio port or second connector 64 of the coupling apparatus 22, for example, via the cable 24. Optionally, at 160, the enclosure 50 is grounded to an earth ground 72 (FIG. 3). Each of acts 152-160 may be performed in a different order.

At 162, signals between the antenna 18*a*, 18*b* and the radio 20*a*, 20*b* are transferred between the coupling antennas 56, 58 within the sealed enclosure 50 of the coupling device 22 via wireless transmission in the air gap formed by the aperture 76 of the partition 74.

The above description of illustrated embodiments, including what is described in the Abstract, is not intended to be exhaustive or to limit the invention to the precise forms disclosed. Although specific embodiments of and examples are described herein for illustrative purposes, various equivalent modifications can be made without departing from the spirit and scope of the invention, as will be recognized by those skilled in the relevant art. The teachings provided herein of the invention can be applied to other systems and devices that employ wireless communications, not necessarily the exemplary ADC system and devices generally described above. For instance, the teachings provided herein may be applicable to other mobile technologies, for example cellular telephones, and/or wirelessly equipped personal digital assistants, and the like. Further, the teachings may be applied to non-mobile or stationary devices, which employ wireless communications for reasons other than mobility. Also for example, while the environments have been identified as being potentially hazardous and non-hazardous, the teachings herein may be applicable to other applications which are not related to potentially hazardous environments, but which require electrical isolation of the radio circuit from the antenna. Such may, for example, allow masking of emissions from the radio circuit at frequencies other frequencies intended for the wireless communications. For example, such may allow the masking of high frequencies which might emit from the radio circuit which may interfere with other electronic equipment or divulge information about the radio circuit or its location.

The foregoing detailed description has set forth various embodiments with the use of flow diagrams. It will be understood by those skilled in the art that some embodiments may employ additional acts, may eliminate some acts and may perform the acts in different orders than illustrated in the flow diagrams.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the various embodiments can be modified, if necessary, to employ systems, circuits and concepts of the various patents, applications and publications to provide yet further embodiments.

These and other changes can be made in light of the above-detailed description. In general, in the following claims, the terms used should not be construed to be limiting to the specific embodiments disclosed in the specification and the claims, but should be construed to include all systems, devices and/or methods that operate in accordance with the claims. Accordingly, the invention is not limited by the disclosure, but instead its scope is to be determined entirely by the following claims.

We claim:

1. A coupling apparatus to provide signal coupling between an antenna and a radio, the coupling apparatus comprising:

a conductive enclosure comprising a first resonance cavity and a second resonance cavity;

a first coupling antenna received in the first resonance cavity, and electrically direct current shorted to the conductive enclosure;

a second coupling antenna received in the second coupling antenna cavity and spaced from the first coupling antenna;

a first connector mounted through a portion of the conductive enclosure to provide a first signal conduit between an exterior of the conductive enclosure and the first coupling antenna; and a second connector mounted through a portion of the conductive enclosure to provide a second signal conduit between the exterior of the conductive enclosure and the second coupling antenna.

2. The coupling apparatus of claim 1 wherein the conductive enclosure comprises at least one partition between the first and the second resonance cavities.

3. The coupling apparatus of claim 2 wherein the partition has an aperture that provides a fluid communication between the first and the second resonance cavities.

4. The coupling apparatus of claim 3 wherein the aperture is sized and dimensioned to pass a narrow band of electromagnetic energy between the first and the second coupling antennas.

5. The coupling apparatus of claim 1 wherein the first coupling antenna and the second coupling antenna are carried by a dielectric substrate.

6. The coupling apparatus of claim 5 wherein the first coupling antenna and second coupling antenna comprise respective conductive traces formed on the dielectric substrate.

7. The coupling apparatus of claim 1 wherein the first coupling antenna is a one quarter wavelength antenna.

8. The coupling apparatus of claim 1 wherein the second coupling antenna is a one half wavelength antenna.

9. The coupling apparatus of claim 8 wherein the first coupling antenna is a one quarter wavelength antenna.

10. The coupling apparatus of claim 1 wherein the enclosure, the first and the second connector completely isolate the first and the second resonance cavities from an exterior of the enclosure.

11. The coupling apparatus of claim 1, further comprising:

an earth ground connector electrically coupled to the conductive enclosure to provide a discharge path.

12. The coupling apparatus of claim 1 wherein the conductive enclosure comprises a metal wall.

13. An apparatus to couple signals between communications components, the apparatus comprising:

a first conductive resonance cavity;

a second conductive resonance cavity;

an electrically direct current shorted first coupling antenna received in the first conductive resonance cavity;

a second coupling antenna received in the second conductive resonance cavity, and spaced from the first coupling antenna, wherein the first and second conductive resonance cavities are sealed from an exterior ambient environment, and the second conductive resonance cavity is separated from the first conductive resonance cavity by a conductive partition, the conductive partition having an aperture therethrough to provide a wireless communications path between the first coupling antenna in the first conductive resonance cavity and the second coupling antenna in the second conductive resonance cavity;

a first connector accessible from the exterior ambient environment and providing a first environmentally sealed signal path to the first coupling antenna in the first resonance cavity; and a second connector accessible from the exterior ambient environment and providing a second environmentally sealed signal path to the second coupling antenna in the second resonance cavity.

14. The apparatus of claim 13 wherein the aperture is sized and dimensioned to pass a narrow band of electromagnetic energy between the first and the second coupling antennas.

15. The apparatus of claim 13 wherein the first coupling antenna comprise a first conductive trace carried by an insulative substrate and the second coupling antenna comprises a second conductive trace carried on the insulative substrate, at least a portion of the second conductive trace being parallel to and spaced from at least a portion of the first conductive trace.

16. The apparatus of claim 15 wherein the first coupling antenna is a one quarter wavelength antenna and the second coupling antenna is a one half wavelength antenna.

17. The apparatus of claim 15 wherein the first and the second coupling antennas are operable to transmit electromagnetic signals of approximately a first wavelength, and wherein the first coupling antenna comprises a first radiating element with a dimension equal to approximately one quarter of the first wavelength of the electromagnetic signals, and wherein the second coupling antenna comprises a second radiating element with a dimension equal to approximately one half of the first wavelength of the electromagnetic signals.

18. The apparatus of claim 16 wherein the second coupling antenna is tapped by the second connector at a position approximately one quarter wavelength along the dimension of the second coupling antenna.

19. The apparatus of claim 18 wherein the second coupling antenna is matched to an impedance of approximately 50 Ohms.

20. A method of forming an apparatus, the method comprising:

forming a first coupling antenna on a dielectric substrate;

forming a second coupling antenna on the dielectric substrate, the second coupling antenna spaced from the first coupling antenna;

positioning the dielectric substrate in an enclosure having a first resonance cavity and a second resonance cavity such that the first coupling antenna is located in the first resonance cavity and the second coupling antenna resides in the second resonance cavity;

providing a direct current shorting path between the first coupling antenna and the enclosure;

providing an environmentally sealed signal path between an exterior of the enclosure and the first coupling antenna; and providing an environmentally sealed signal path between an exterior of the enclosure and the second coupling antenna.

21. The method of claim 20 wherein forming a first coupling antenna on a dielectric substrate comprises depositing a conductive material on the dielectric substrate.

22. The method of claim 21 wherein depositing a conductive material on the dielectric substrate printing on the dielectric substrate with a conductive ink.

23. The method of claim 20 wherein forming a first coupling antenna on a dielectric substrate comprises etching a conductive layer carried by a dielectric layer.

24. The method of claim 20 wherein providing an environmentally sealed signal path between an exterior of the enclosure and the first coupling antenna comprises locating a first electrical connector through a wall of the enclosure.

25. A method of using an apparatus, the method comprising:

locating an antenna in a hazardous environment;

locating a radio circuit in a non-hazardous environment; and coupling the radio and the antenna with a coupling device comprising an enclosure having a first conductive resonance cavity and a second conductive resonance cavity, a first coupling antenna positioned in the first conductive resonance cavity and a second coupling antenna positioned in the second conductive resonance cavity, the first coupling antenna having a direct current short to the enclosure, and at least one aperture coupling the first and second conductive resonance cavities.

26. The method of claim 25, further comprising:

transferring signals between the antenna and the radio via wireless transmission between the first and the second coupling antennas.

27. The method of claim 25, further comprising:

grounding the enclosure to an earth ground.

28. The method of claim 25 wherein coupling the radio and the antenna with a coupling device comprises:

electrically connecting the antenna to a first connector that provides an environmentally sealed signal path between an ambient environment an exterior of the enclosure and the first coupling antenna; and electrically connecting the radio to a second connector that provides an environmentally sealed signal path between an exterior of the enclosure and the second coupling antenna.

29. The method of claim 25, further comprising:

locating the coupling device in the hazardous environment.

* * * * *